US009008536B2

(12) United States Patent
Hashimoto

(10) Patent No.: US 9,008,536 B2
(45) Date of Patent: Apr. 14, 2015

(54) IMAGE FORMING APPARATUS HAVING PAPER DUST CLEANING UNIT MOVABLY PROVIDED ON PHOTOSENSITIVE MEMBER UNIT

(75) Inventor: Junichi Hashimoto, Toyohashi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 261 days.

(21) Appl. No.: 13/613,582

(22) Filed: Sep. 13, 2012

(65) Prior Publication Data

US 2013/0084096 A1 Apr. 4, 2013

(30) Foreign Application Priority Data

Sep. 30, 2011 (JP) ..... 2011-217113

(51) Int. Cl.

| | |
|---|---|
| ***G03G 21/00*** | (2006.01) |
| ***G03G 21/18*** | (2006.01) |
| ***G03G 15/00*** | (2006.01) |
| ***G03G 15/01*** | (2006.01) |

(52) U.S. Cl.

CPC ..... *G03G 21/1853* (2013.01); *G03G 15/6558* (2013.01); *G03G 15/0194* (2013.01); *G03G 2215/00708* (2013.01); *G03G 2215/0141* (2013.01); *G03G 2221/1684* (2013.01)

(58) Field of Classification Search

CPC ..... G03G 15/0194; G03G 21/1853; G03G 15/6558; G03G 21/1821; G03G 2215/00708

USPC ..... 399/98, 390

See application file for complete search history.

(56) References Cited

U.S. PATENT DOCUMENTS

| | | | |
|---|---|---|---|
| 6,219,505 | B1 | 4/2001 | Sato et al. |
| 6,415,119 | B2 | 7/2002 | Nishimura et al. |
| 2001/0028813 | A1 | 10/2001 | Nishimura et al. |
| 2001/0031154 | A1 | 10/2001 | Sato et al. |
| 2003/0049043 | A1 | 3/2003 | Fuwazaki et al. |
| 2006/0067734 | A1 | 3/2006 | Igarashi et al. |
| 2007/0048006 | A1 | 3/2007 | Igarashi et al. |
| 2011/0280617 | A1 | 11/2011 | Iino et al. |

FOREIGN PATENT DOCUMENTS

| | | | |
|---|---|---|---|
| JP | 2001-270631 | A | 10/2001 |
| JP | 2006-098772 | A | 4/2006 |
| JP | 2007-062967 | A | 3/2007 |
| JP | 2010-235248 | A | 10/2010 |
| JP | 2011-237685 | A | 11/2011 |

*Primary Examiner* — David Gray
*Assistant Examiner* — Laura Roth
(74) *Attorney, Agent, or Firm* — Banner & Witcoff, Ltd.

(57) ABSTRACT

An image forming apparatus includes: a main body having a pinch roller; a supporting member configured to support a plurality of cartridges; and a cleaning unit provided on the supporting member. The supporting member is movable, relative to the main body, between an internal position located inside the main body and an external position located outside the main body. The cleaning unit includes: a paper dust roller for removing paper dust from recording sheets; a paper dust removing member for removing the paper dust; and a storing section for string the paper dust. The paper dust roller is movable relative to the supporting member and positioning of the paper dust roller relative to the pinch roller is independent of positioning of the supporting member relative to the main body.

12 Claims, 10 Drawing Sheets

IMAGE FORMING APPARATUS HAVING PAPER DUST CLEANING UNIT MOVABLY PROVIDED ON PHOTOSENSITIVE MEMBER UNIT

CROSS REFERENCE TO RELATED APPLICATION

This application claims priority from Japanese Patent Application No. 2011-217113 filed Sep. 30, 2011. The entire content of the priority application is incorporated herein by reference.

TECHNICAL FIELD

The present invention relates to an image forming apparatus, and particularly to a photosensitive member unit in the image forming apparatus having a support member for supporting a plurality of photosensitive members, and a cleaning unit.

BACKGROUND

An electrophotographic image forming apparatus known in the art includes a drawer unit (support member) for retaining a plurality of photosensitive drums. The drawer unit is detachably mountable in a main body of the image forming apparatus. A pair of registration rollers is provided near an opening formed in the main body through which the drawer unit is pushed and pulled. One of registration rollers in this image forming apparatus is a paper dust roller that removes paper dust from a recording sheet nipped between the registration rollers. Disposed adjacent to the paper dust roller are a paper-dust removing unit for scraping paper dust off the paper dust roller and a paper-dust collecting unit (reservoir) for storing the paper dust removed from the paper dust roller.

SUMMARY

However, the paper-dust collecting unit is provided near the opening in the main body through which the drawer unit is inserted into and removed from the conventional image forming apparatus described above. Therefore, the drawer unit must be pulled over the paper-dust collecting unit when removing the drawer unit from the main body, if the paper-dust collecting unit is formed large enough to store a sufficient amount of paper dust. Operability of the drawer unit thus suffers.

In view of the foregoing, it is an object of the present invention to provide an image forming apparatus having a reservoir that has a sufficient space for storing paper dust removed from recording sheets by a paper dust roller and that does not interfere with a support member when the support member is pulled out of a main body of the image forming apparatus.

In order to attain the above and other objects, there is provided an image forming apparatus including: a main body having a pinch roller; a supporting member configured to support a plurality of cartridges; and a cleaning unit provided on the supporting member. The supporting member is configured to move, relative to the main body, between an internal position located inside the main body and an external position located outside the main body. The cleaning unit includes: a paper dust roller configured to nip a recording sheet in conjunction with the pinch roller for removing the paper dust from the recording sheet; a paper dust removing member configured to remove the paper dust from the paper dust roller; and a storing section configured to store the paper dust removed by the paper dust removing member. The paper dust roller is movable relative to the supporting member and positioning of the paper dust roller relative to the pinch roller is independent of positioning of the supporting member relative to the main body.

According to another aspect, the present invention provides a photosensitive member unit. The photosensitive member unit includes: a supporting member configured to support a plurality of photosensitive members; and a cleaning unit configured to remove paper dust from a recording sheet. The cleaning unit includes: a paper dust roller configured to nip the recording sheet in conjunction with an opposing roller for removing the paper dust from the recording sheet; a paper dust removing member configured to remove the paper dust from the paper dust roller; and a storing portion configured to store the paper dust removed by the paper dust removing member. The paper dust roller is movable relative to the supporting member.

According to still another aspect of the present invention, there is provided an image forming apparatus including: a main body having a pinch roller; a supporting member configured to support a plurality of cartridges; a belt configured to convey a recording sheet in a sheet conveying direction; and a cleaning unit provided on the supporting member. The supporting member is configured to move, relative to the main body, between an internal position located inside the main body and an external position located outside the main body. The belt is disposed below the supporting member when the supporting member is at the internal position. The cleaning unit is provided on the supporting member at a position upstream of the belt in the sheet conveying direction. The cleaning unit includes: a paper dust roller configured to nip the recording sheet in conjunction with the pinch roller for removing the paper dust from the recording sheet; a paper dust removing member configured to remove the paper dust from the paper dust roller; and a storing portion configured to store the paper dust removed by the paper dust removing member.

BRIEF DESCRIPTION OF THE DRAWINGS

The particular features and advantages of the invention as well as other objects will become apparent from the following description taken in connection with the accompanying drawings, in which.

DETAILED DESCRIPTION

Figure 1:
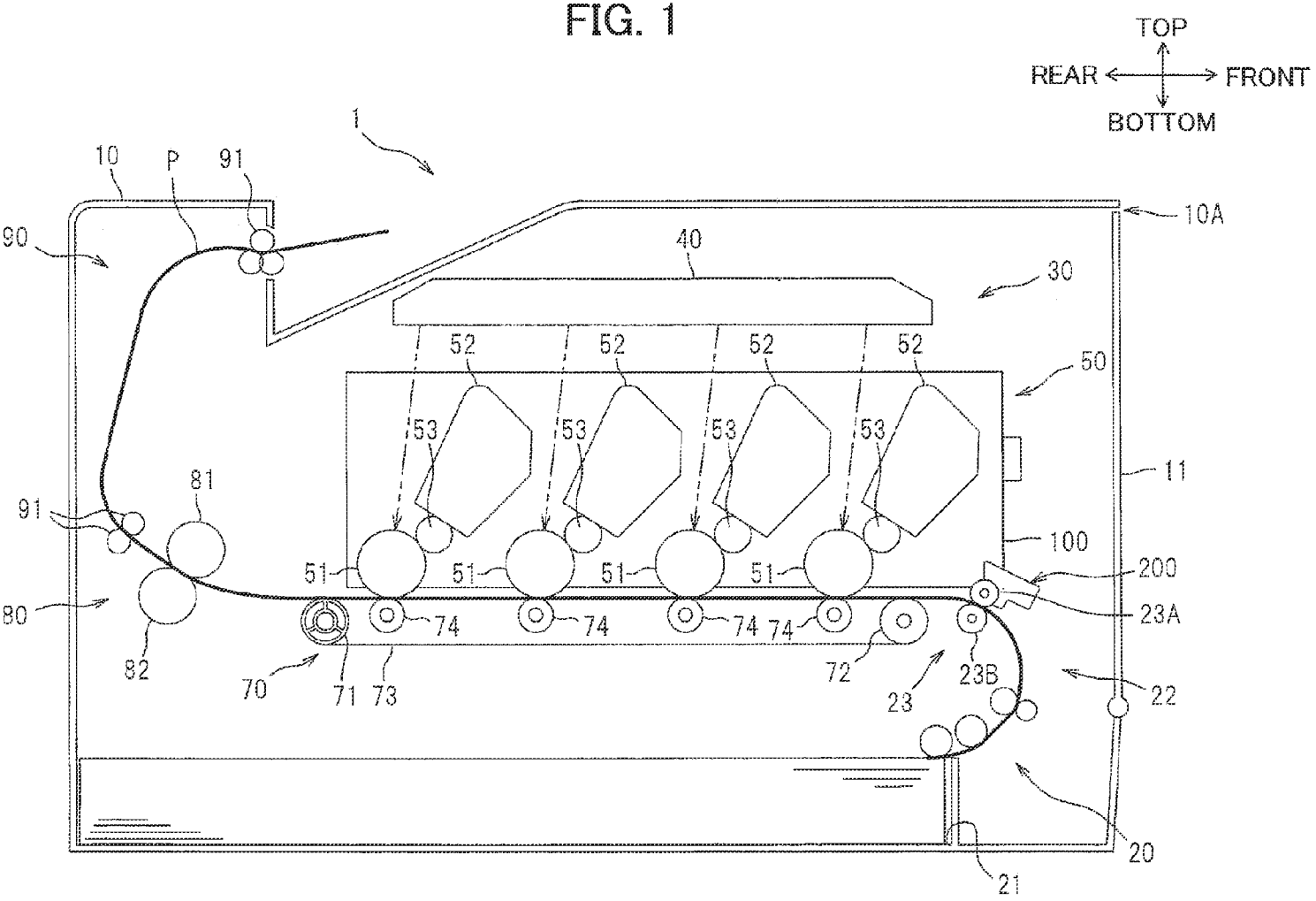
FIG. 1 is a schematic side view showing a simplified structure of a color printer as an example of an image forming apparatus according to an embodiment of the present invention, wherein the color printer accommodates a drawer therein (the drawer is at an internal position)

A color printer 1 as an example of an image forming apparatus according to an embodiment of the present invention will be described while referring to FIGS. 1 to 10B wherein like parts and components are designated by the same reference numerals to avoid duplicating description.

Throughout the specification, the terms "upward", "downward", "upper", "lower", "above", "below", "beneath", "right", "left", "front", "rear" and the like will be used throughout the description assuming that the color printer 1 is disposed in an orientation in which it is intended to be used. In use, the color printer 1 is disposed as shown in FIG. 1. Specifically, in FIG. 1, the right side is a front side (near side), and the left side is a rear side (far side) of the color printer 1. The near side in FIG. 1 is a left side, and the far side in FIG. 1 is a right side of the color printer 1. Further, the top and bottom of the color printer 1 will be based on a vertical direction in FIG. 1.

<Overall Structure of Color Printer>

As shown in FIG. 1, the color printer 1 includes a main body 10. A front cover 11 is provided on the front side of the main body 10 and is configured to pivotally move about a bottom end of the main body 10 to open and close an aperture 10A formed in the main body 10.

Within the main body 10, a sheet-feeding unit 20, an image-forming unit 30 and a discharge unit 90 are disposed. The sheet-feeding unit 20 serves to supply sheets P to be printed to the image-forming unit 30. The image-forming unit 30 serves to form images on the sheets P supplied by the sheet-feeding unit 20. The discharge unit 90 serves to discharge the sheets P after images have been formed thereon.

The sheet-feeding unit 20 includes a sheet tray 21 accommodating the sheets P, a sheet-conveying device 22 for conveying the sheet P from the sheet tray 21 to the image-forming unit 30, and a pair of registration rollers 23.

In the sheet-feeding unit 20, the sheet-conveying device 22 conveys the sheets P from the sheet tray 21 while separating the sheets P so that one sheet is conveyed at a time. The sheets P pass between the registration rollers 23 and are supplied to the image-forming unit 30.

Before the sheet P is supplied to the image-forming unit 30, the sheet P is temporarily halted when a leading edge thereof contacts the pair of registration rollers 23. In this way, the registration rollers 23 correct skew in the sheet P and adjust the timing and the like at which an image is formed on the sheet P. The registration rollers 23 include a paper dust roller 23A, and a pinch roller 23B that is rotatably provided in the main body 10. A driving force is transmitted to the paper dust roller 23A from a motor (not shown). As will be described later, the paper dust roller 23A is provided on a drawer 100 as part of a cleaning unit 200 described later.

The image-forming unit 30 includes a scanning unit 40, a photosensitive member unit 50, a transfer unit 70, and a fixing unit 80.

The scanning unit 40 is provided in an upper portion of the main body 10. While not shown in the drawings, the scanning unit 40 includes a laser light-emitting unit, a polygon mirror, reflecting mirrors, and the like. Laser beams emitted from the scanning unit 40 follow paths indicated by two-dot chain lines in FIG. 1 and are irradiated in a high-speed scan over surfaces of photosensitive drums 51 (described later) in the photosensitive member unit 50.

Figure 3:
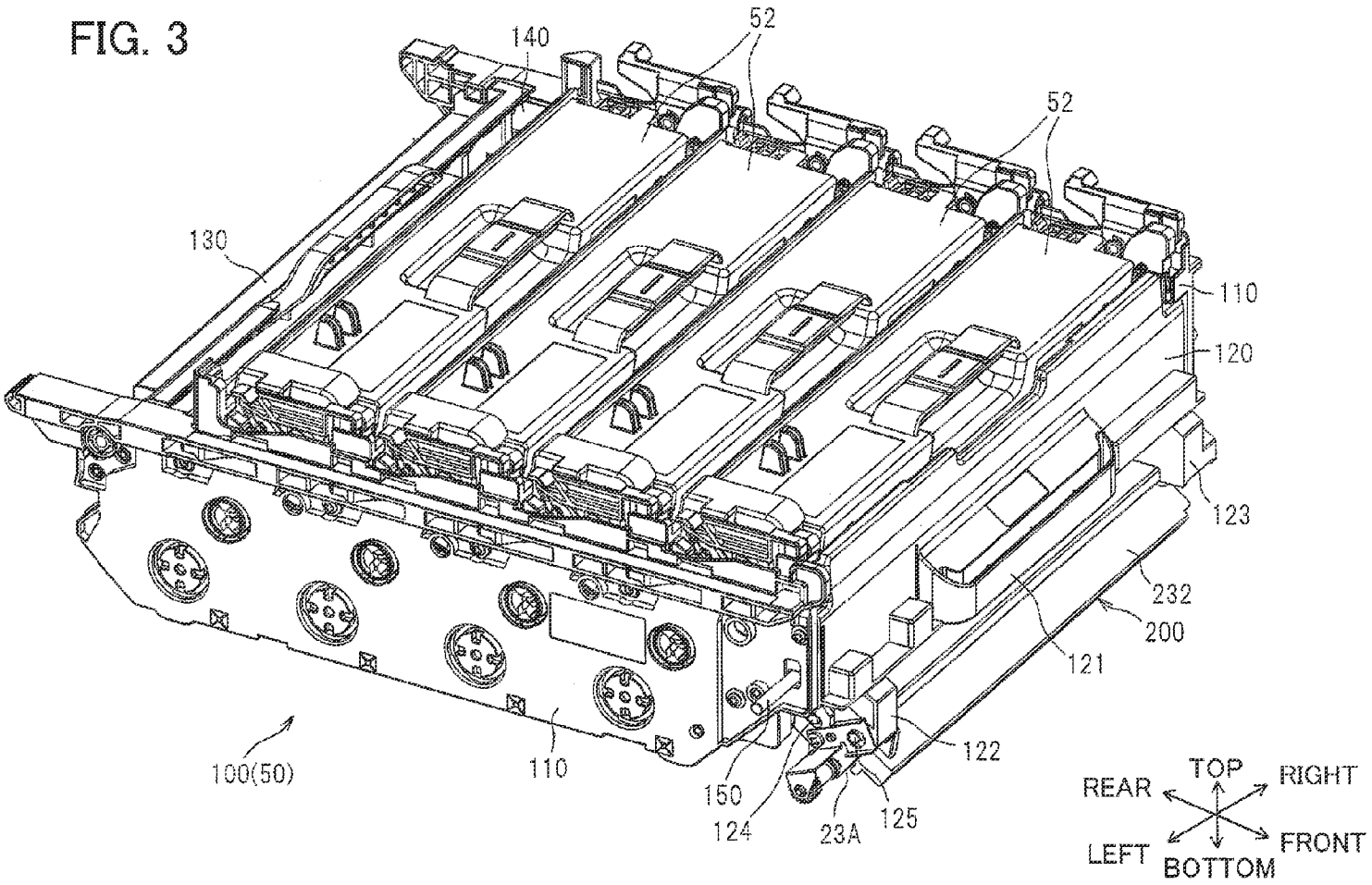
FIG. 3 is a perspective view of the drawer as viewed from upward and leftward thereof.
Figure 4:
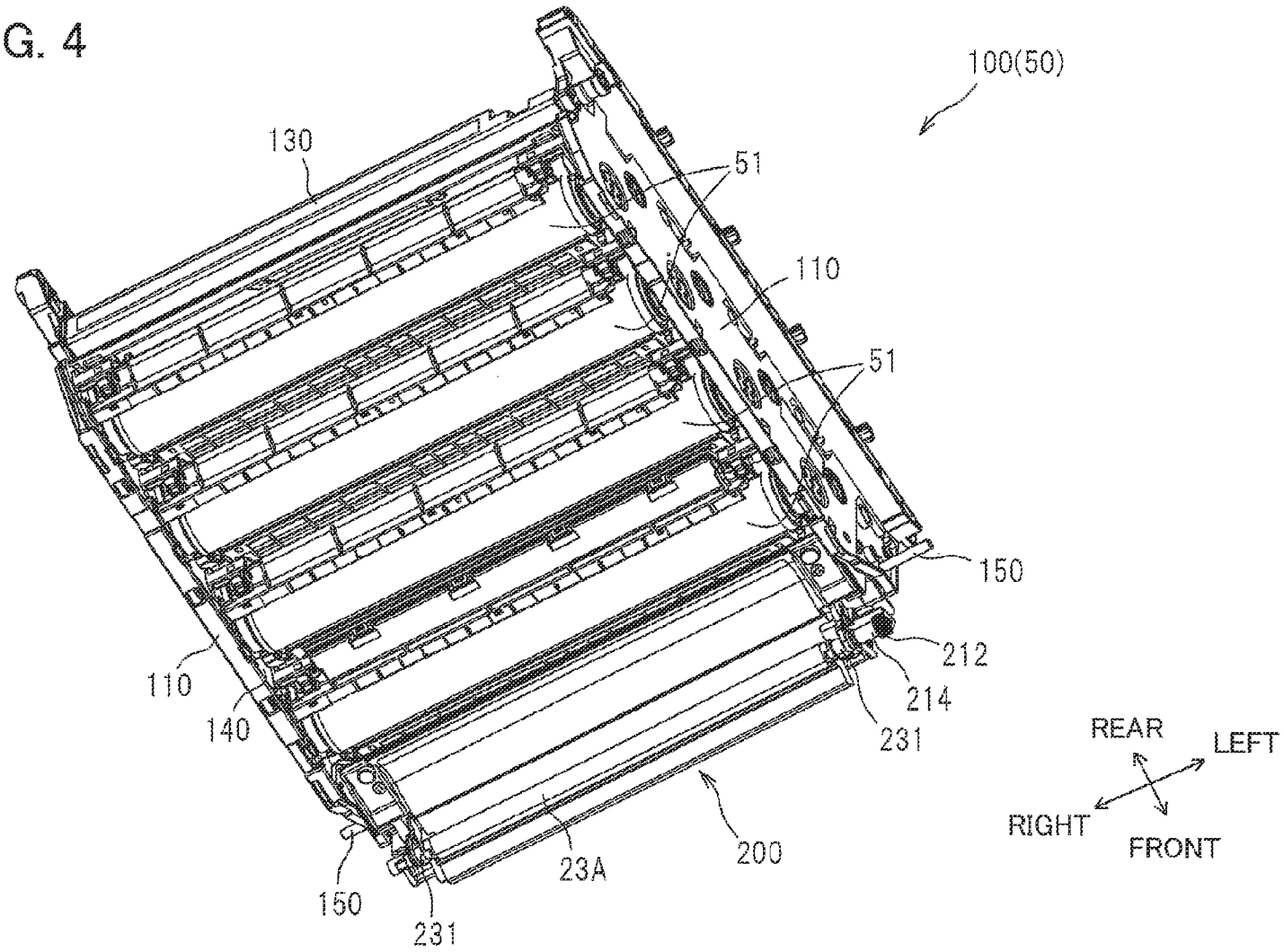
FIG. 4 is a perspective view of the drawer as viewed from downward thereof.

As shown in FIGS. 3 and 4, the photosensitive member unit 50 includes the drawer 100 (an example of a supporting member), four photosensitive drums 51 rotatably retained in the drawer 100, four developer cartridges 52 detachably provided in the drawer 100 to correspond to the four photosensitive drums 51, and the cleaning unit 200.

Figure 2:
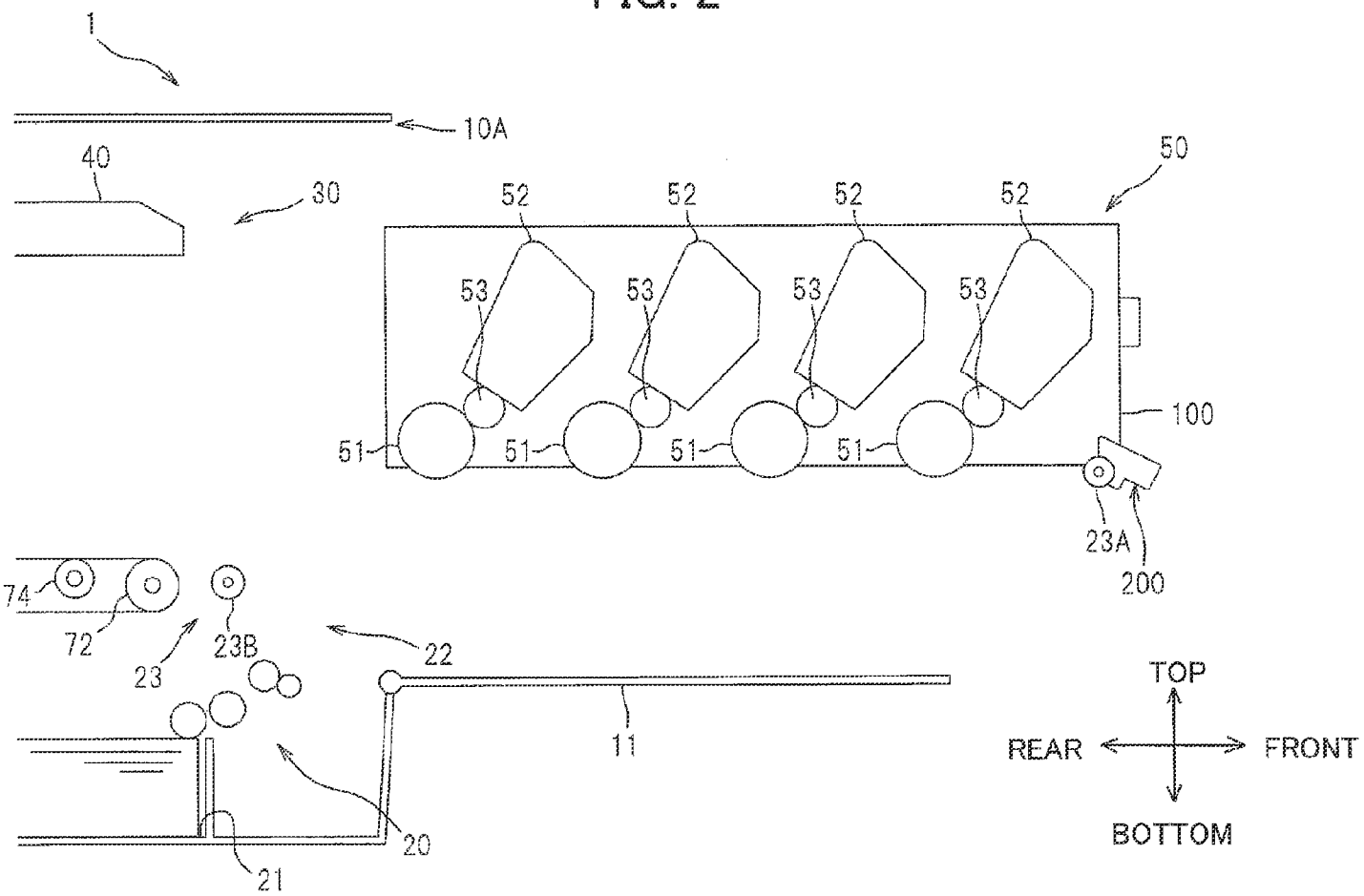
FIG. 2 is a simplified view showing a state where the drawer is pulled out (the drawer is at an external position), the drawer including a cleaning unit.

The drawer 100 can be displaced between an internal position (the position shown in FIG. 1) and an external position (the position shown in FIG. 2). In the internal position, the drawer 100 is accommodated in the main body 10 and fixed in position relative to the same. In the external position, the drawer 100 is located outside the main body 10. Here, "outside the main body 10" implies that the drawer 100 is withdrawn from the main body 10 such that the developer cartridges 52 can be mounted in and removed from the drawer 100. In the external position, the drawer 100 may be or may not be completely detached from the main body 10. The photosensitive member unit 50 will be described later in greater detail.

When the photosensitive member unit 50 is mounted in the main body 10, the photosensitive drums 51 in the photosensitive member unit 50 are arranged parallel to each other and spaced in a front-to-rear direction. Chargers and the like (not shown) well known in the art are provided in the drawer 100 as needed. A developing roller 53 is rotatably provided in each developer cartridge 52 for supplying toner to the corresponding photosensitive drum 51. Each developer cartridge 52 is also provided with a toner-accommodating chamber, a supply roller, and other components known in the art.

The transfer unit 70 is disposed between the sheet-feeding unit 20 and the photosensitive member unit 50. The transfer unit 70 includes a drive roller 71, a follow roller 72, a conveying belt 73, and four transfer rollers 74.

The drive roller 71 and the follow roller 72 are arranged parallel to each other and spaced apart in the front-to-rear direction. The conveying belt 73 is an endless belt that is stretched taut around the drive roller 71 and the follow roller 72. The conveying belt 73 has an outer surface that contacts each of the photosensitive drums 51. The four transfer rollers 74 are disposed inside a loop formed by the conveying belt 73 at positions opposing the photosensitive drums 51 with the conveying belt 73 interposed between the transfer rollers 74 and corresponding photosensitive drums 51. A transfer bias is applied to the transfer rollers 74 during a transfer operation through constant current control.

The fixing unit 80 is disposed rearward of the photosensitive member unit 50 and transfer unit 70. The fixing unit 80 includes a heating roller 81, and a pressure roller 82 that confronts and presses against the heating roller 81.

With the image-forming unit 30 configured as described above, first the chargers apply a uniform charge to the surfaces of the corresponding photosensitive drums 51. Subsequently, the scanning unit 40 irradiates light onto the surfaces of the photosensitive drums 51 based on image data. The irradiated light lowers electric potentials in exposed regions on the surfaces of the photosensitive drums 51, forming electrostatic latent images thereon. Next, the developing rollers 53 supply toner from the developer cartridges 52 to the latent images formed on the corresponding photosensitive drums 51 to produce toner images.

Next, as the sheet P supplied onto the conveying belt 73 passes between the photosensitive drums 51 and transfer rollers 74, the toner images formed on the photosensitive drums 51 are transferred onto the sheet P. These toner images transferred onto the sheet P are subsequently fixed to the sheet P by heat as the sheet P passes between the heating roller 81 and pressure roller 82.

The discharge unit 90 primarily includes a plurality of conveying rollers 91 for conveying the sheets P. After the toner images have been transferred and fixed to the sheet P, the conveying rollers 91 convey the sheet P out of the main body 10.

<Detailed Structure of Photosensitive Member Unit>

Next, a structure of the photosensitive member unit 50 will be described in detail with reference to FIGS. 3 to 8B. As shown in FIG. 3, the photosensitive member unit 50 includes the drawer 100, the cleaning unit 200, and coil springs 270 (see FIG. 7A).

As shown in FIGS. 3 and 4, the drawer 100 has a rectangular frame-like shape. The four photosensitive drums 51 and four developer cartridges 52 are retained inside the drawer 100 at intervals in the front-to-rear direction.

More specifically, the drawer 100 primarily includes a pair of left and right side walls 110, a front beam 120 connecting front ends of the side walls 110, a rear beam 130 connecting rear ends of the side walls 110, a pair of metal plates 140, and a shaft 150.

The front beam 120 has a handle 121, and cleaning-unit retaining parts 122 and 123.

The handle 121 is provided on a front surface of the front beam 120. By gripping the handle 121, a user can move the drawer 100 between the external position and internal position.

The cleaning-unit retaining parts 122 and 123 are provided on left and right ends of the front beam 120, respectively. The cleaning-unit retaining parts 122 and 123 are side supporting walls extending downward from a bottom edge of the front beam 120.

On the left cleaning-unit retaining part 122 formed are a first protrusion 124 that protrudes leftward from a left surface of the left cleaning-unit retaining part 122, i.e., outward in an axial direction of the paper dust roller 23A; and a second protrusion 125 protruding from the same surface (the left surface) of the left cleaning-unit retaining part 122 and in the same direction (outward in the axial direction of the paper dust roller 23A) at a position forward of the first protrusion 124.

In the right cleaning-unit retaining part 123 formed are an elongate hole (not shown) and a support hole (not shown) both penetrating through the right cleaning-unit retaining part 123 in a left-to-right direction, the support hole being formed at a position forward of the elongate hole.

Figure 7A:
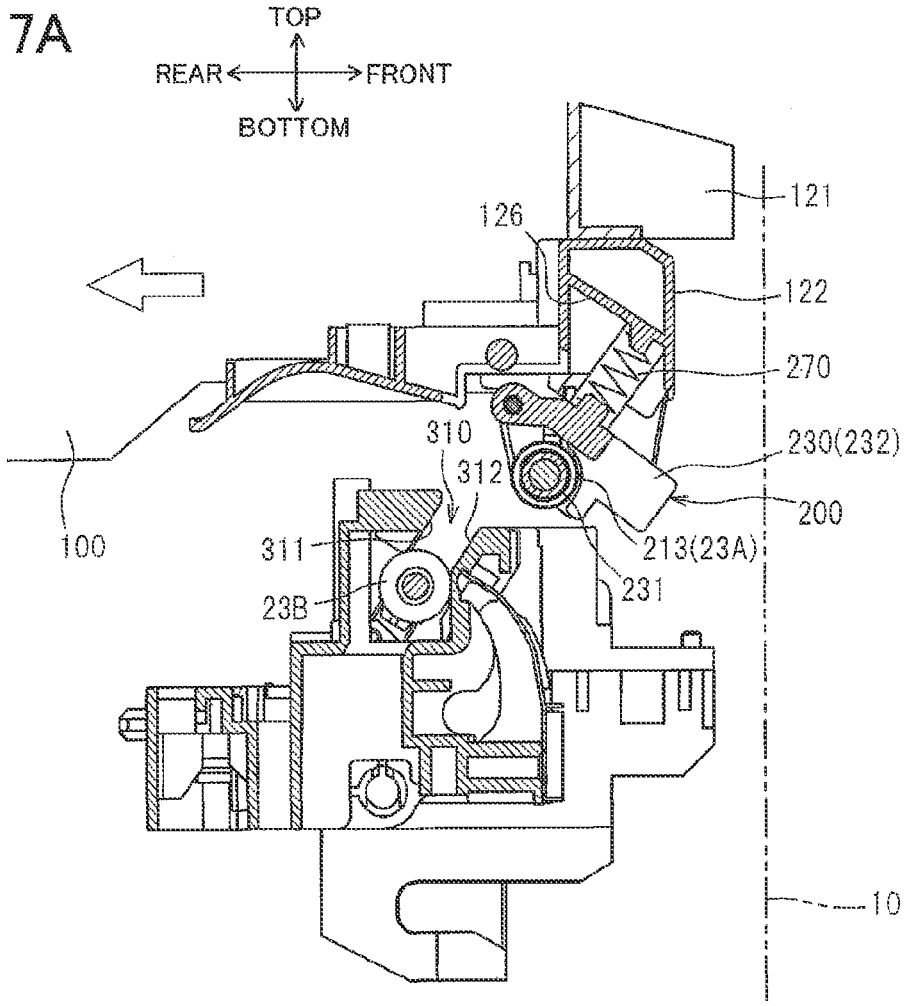
FIGS. 7A and 7B are views illustrating a construction around a pinch roller disposed in the color printer in relation to the paper dust roller of the cleaning unit when the cleaning unit is about to be mounted.

Further, as shown in FIG. 7A, a spring mounting part 126 is formed on a bottom surface of each of the cleaning-unit retaining parts 122 and 123 for supporting the coil springs 270.

As shown in FIGS. 3 and 4, the plates 140 are metal plates extending in the front-to-rear direction. The metal plates 140 are disposed on inner surfaces of the pair of side walls 110 (only the right plate 140 is shown in the drawings) and function to rotatably support the four photosensitive drums 51. The photosensitive drums 51 can be grounded by connecting the metal plates 140 to a ground member (not shown) provided in the main body 10 when the drawer 100 is in the internal position.

The shaft 150 is a metal shaft extending in the left-to-right direction. The shaft 150 couples the side walls 110 and the metal plates 140 at a front end portion of the drawer 100. The shaft 150 has left and right end portions protruding outward from the respective side walls 110.

When the drawer 100 having the above construction is in the internal position, positioning of the drawer 100 relative to the main body 10 is achieved by a positioning portion (not shown) provided in the main body 10.

The cleaning unit 200 functions to remove paper dust from the sheet P nipped between the registration rollers 23. As shown in FIG. 2, the cleaning unit 200 is integrally provided on the drawer 100 so as to move together with the drawer 100 when the drawer 100 is pulled out from the internal position to the external position.

Figure 5A:
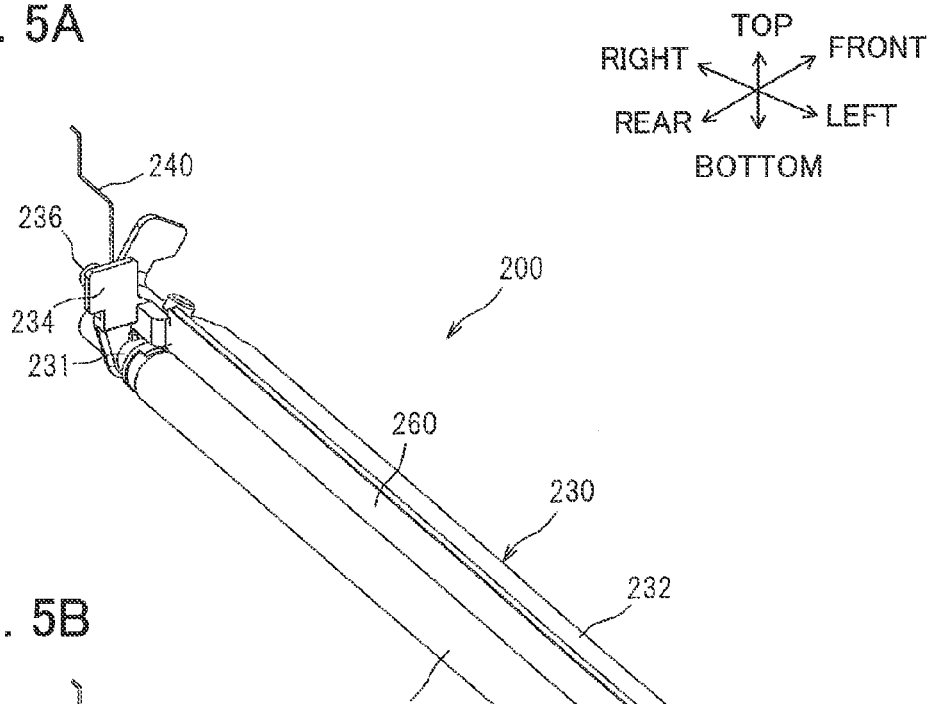
FIG. 5A is a perspective view of the cleaning unit, wherein a paper dust roller is supported to a casing of the cleaning unit.
Figure 5B:
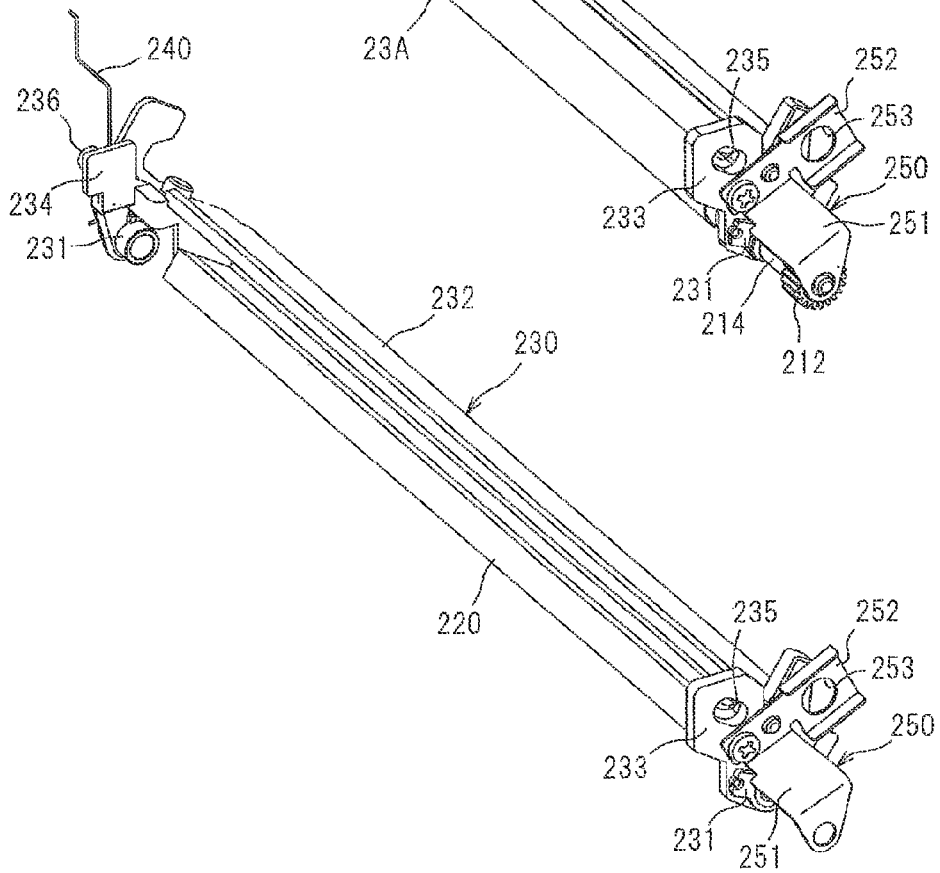
FIG. 5B is a perspective view of the cleaning unit, wherein the paper dust roller and a urethane sheet are removed from the casing of the cleaning unit.

Specifically, as shown in FIGS. 5A and 5B, the cleaning unit 200 includes the paper dust roller 23A, a paper-dust removing member 220, a case 230, a paper-dust-roller grounding member 240, and a gear holder 250.

As shown in FIG. 1, the paper dust roller 23A is one roller constituting the pair of registration rollers 23. By rotating the paper dust roller 23A so that its peripheral surface slides against the paper-dust removing member 220 described below, the peripheral surface of the paper dust roller 23A is tribocharged and can attract (remove) paper dust from each sheet P nipped between the registration rollers 23.

Figure 6:
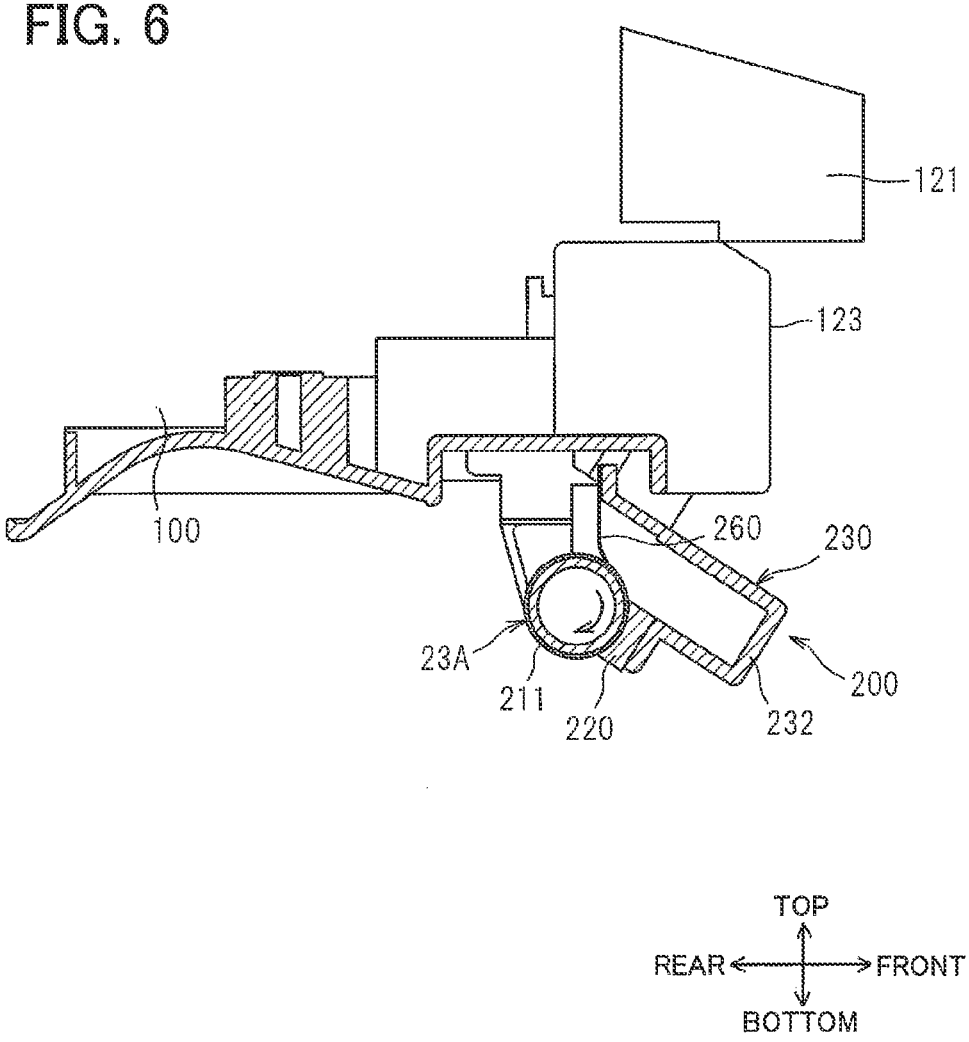
FIG. 6 is a cross-sectional view of an area adjacent to the cleaning unit.

The paper dust roller 23A is a metal roller. As shown in FIG. 6, the peripheral surface of the paper dust roller 23A is sheathed in a tube 211 formed of a fluoropolymer. The tube 211 aids in tribocharging the surface of the paper dust roller 23A.

As shown in FIG. 5A, an input gear 212 is provided on a left end portion of the paper dust roller 23A for applying a rotational force to the same. More specifically, the input gear 212 is configured to be rotated by a driving force received from a motor (not shown) provided in the main body 10. The input gear 212 is connected via a universal joint 214 to a rotational shaft 213 (see FIG. 7A) that rotates integrally with the paper dust roller 23A. By connecting the input gear 212 to the rotational shaft 213 with the universal joint 214, the input gear 212 can be displaced relative to the rotational shaft 213 (the paper dust roller 23A) along a radial direction of the paper dust roller 23A. With this structure, even if the rotational shaft 213 of the paper dust roller 23A is displaced when the sheet P is nipped between the registration rollers 23, such displacement will not affect the input gear 212. Accordingly, this configuration can reduce noise in the resulting image.

The paper-dust removing member 220 functions to scrape off (remove) paper dust attracted to the surface of the paper dust roller 23A. As shown in FIG. 6, the paper-dust removing member 220 is provided at the case 230 such that the paper-dust removing member 220 slidingly contacts the peripheral surface of the paper dust roller 23A at a position downward and frontward thereof. The paper-dust removing member 220 is formed of a urethane sponge or the like and in pressure contact with the paper dust roller 23A. By slidingly contacting the paper-dust removing member 220, the peripheral surface of the paper dust roller 23A is tribocharged.

The case 230 rotatably supports the paper dust roller 23A. As shown in FIGS. 5A and 5B, the case 230 is integrally provided with a pair of bearing parts 231, a storing part 232, and support parts 233 and 234.

The bearing parts 231 have a cylindrical shape and are formed of an electrically conductive resin. The bearing parts 231 are disposed one on each lateral end of the paper dust roller 23A and rotatably support the same.

As shown in FIG. 6, the storing part 232 is disposed frontward of the paper dust roller 23A. The storing part 232 is box-shaped and closed at its bottom in order to collect paper dust scraped off the paper dust roller 23A by the paper-dust removing member 220. In other words, the storing part 232 is generally C-shaped in cross-section and is formed with an opening facing rearward (toward the paper dust roller 23A). The storing part 232 has an upper-rear end portion and a lower-rear end portion defining the opening. The paper-dust removing member 220 is provided on the lower-rear end portion of the storing part 232 (an end portion positioned downstream in a rotating direction of the paper dust roller 23A, which is indicated as an arrow in FIG. 6) to close a gap formed between the paper dust roller 23A and the lower-rear end portion. An urethane sheet 260 is provided on the upper-rear end portion of the storing part 232 (another end portion positioned upstream in the rotating direction of the paper dust roller 23A) and extends to reach the surface of paper dust roller 23A in order to prevent paper dust collected in the storing part 232 from leaking out therefrom.

As shown in FIGS. 5A and 5B, the support parts 233 and 234 are disposed above the corresponding bearing parts 231. The support parts 233 and 234 are formed in flat plate shapes that conform to the cleaning-unit retaining parts 122 and 123 of the drawer 100.

An elongate hole 235 is formed in the left support part 233. The elongate hole 235 penetrates through the left support part 233 in the left-to-right direction and serves to engage the first protrusion 124 formed on the left cleaning-unit retaining part 122. When the drawer 100 is in the internal position, the elongate hole 235 extends along a direction orthogonal to a direction in which the registration rollers 23 confront each other (see FIG. 8B). The elongate hole (not shown) formed in the right cleaning-unit retaining part 123 described earlier is aligned with the elongate hole 235 in the left-to-right direction and extends in the same direction as the elongate hole 235 (in the direction orthogonal to the confronting direction of the registration rollers 23).

Two protrusions 236 (only one is shown in FIGS. 5A and 5B) are formed on a right surface of the right support part 234, the right surface opposing the right cleaning-unit retaining part 123. The protrusions 236 are aligned with each other in the front-to-rear direction and respectively engage the elongate hole and the support hole (both not shown) formed in the right cleaning-unit retaining part 123.

The paper-dust-roller grounding member 240 is configured of a wire, for example. The paper-dust-roller grounding member 240 has one end electrically connected to the paper dust roller 23A via the right bearing part 231, and another end electrically connected to the metal plate 140 (the right plate 140) of the drawer 100 to be grounded through the same. In this way, the paper-dust-roller grounding member 240 serves to ground the paper dust roller 23A.

The gear holder 250 is formed of a metal plate and is disposed so as to cover the input gear 212 from above. Specifically, the gear holder 250 includes a cover part 251 for covering the top of the input gear 212, and a fixing part 252 that is fixed to the support part 233 of the case 230.

The fixing part 252 extends first upward, then forward from a right end portion of the cover part 251. The fixing part 252 has an engaging hole 253 that penetrates through a front end portion of the fixing part 252 in the left-to-right direction. The engaging hole 253 engages the second protrusion 125 formed on the left cleaning-unit retaining part 122 of the drawer 100 and has a diameter larger than that of the second protrusion 125. The support hole (not shown) formed in the right cleaning-unit retaining part 123 described above is aligned with the engaging hole 253 in the left-to-right direction and has a diameter larger than that of the corresponding protrusion 236 (to be engaged with the support hole) formed on the right support part 234 of the cleaning unit 200.

Figure 7B:
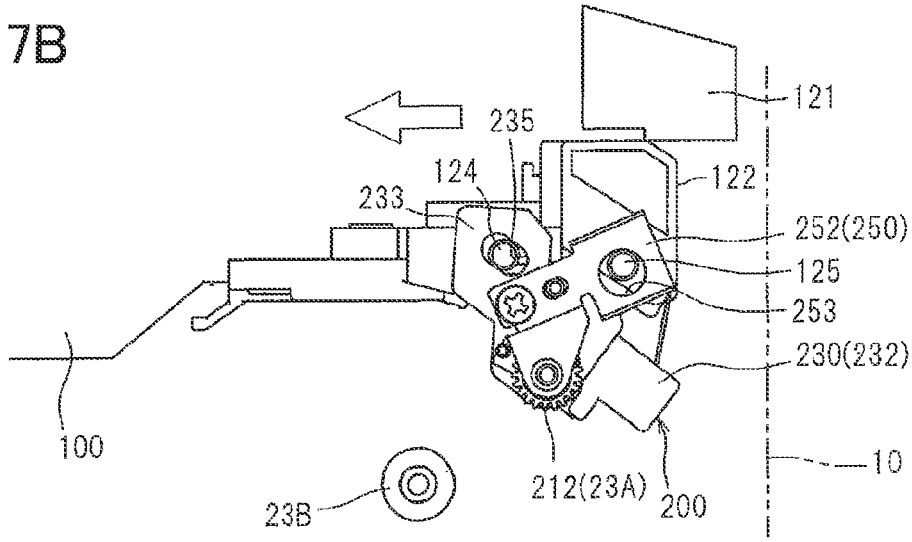

The cleaning unit 200 having the above construction is supported on the drawer 100 by engaging the protrusions 236 provided on the right support part 234 with the corresponding elongate hole and the support hole (not shown) formed on the right cleaning-unit-retaining part 123 and, as illustrated in FIG. 7B, by engaging the elongate hole 235 and the engaging hole 253 with the corresponding first protrusion 124 and the second protrusion 125 formed on the left cleaning-unit-retaining part 122. When supported on the drawer 100 in this way, the cleaning unit 200 can pivotally move in the front-to-rear direction relative to the drawer 100. In other words, the paper dust roller 23A can move relative to the drawer 100.

As shown in FIG. 7A, the coil springs 270 are interposed between the case 230 of the cleaning unit 200 and the corresponding spring mounting parts 126 provided on the drawer 100. The coil springs 270 bias the bearing parts 231 of the cleaning unit 200 toward guides 310 (described later). More specifically, this direction in which the coil springs 270 biases the cleaning unit 200 is coincident with the confronting direction of the registration rollers 23.

<Structure of Main Body>

Figure 8A:
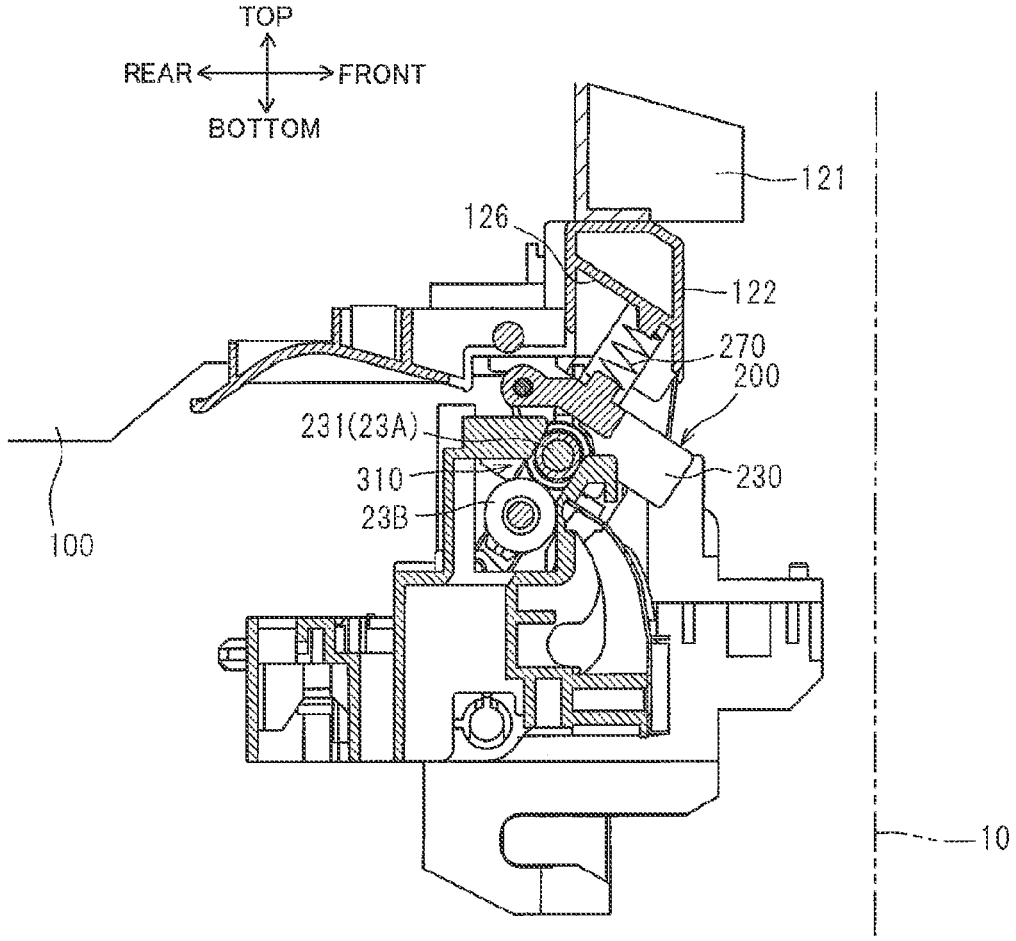
FIGS. 8A and 8B are views illustrating the construction around the pinch roller and the paper dust roller of the cleaning unit that has been mounted.
Figure 8B:
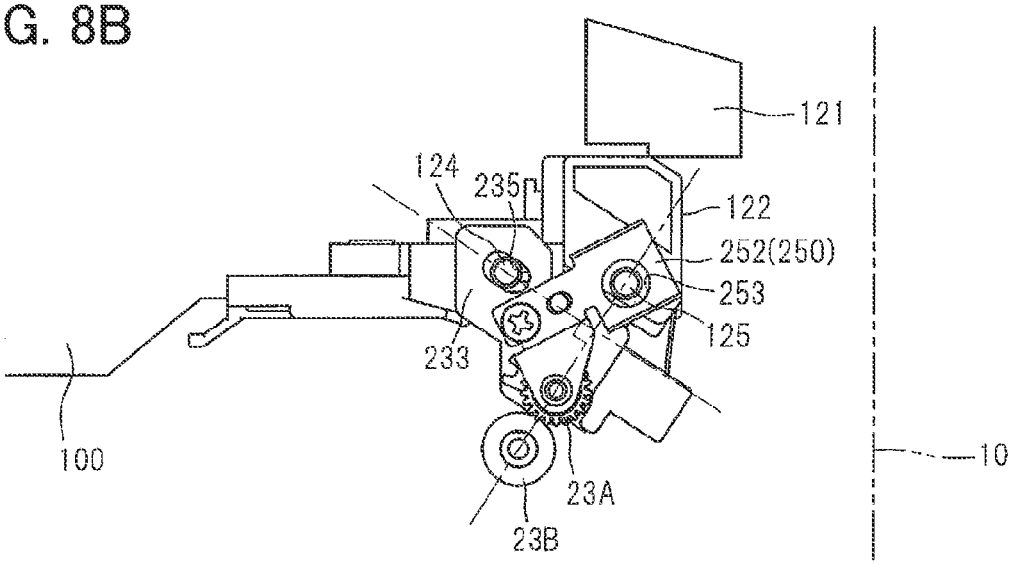
Figure 9:
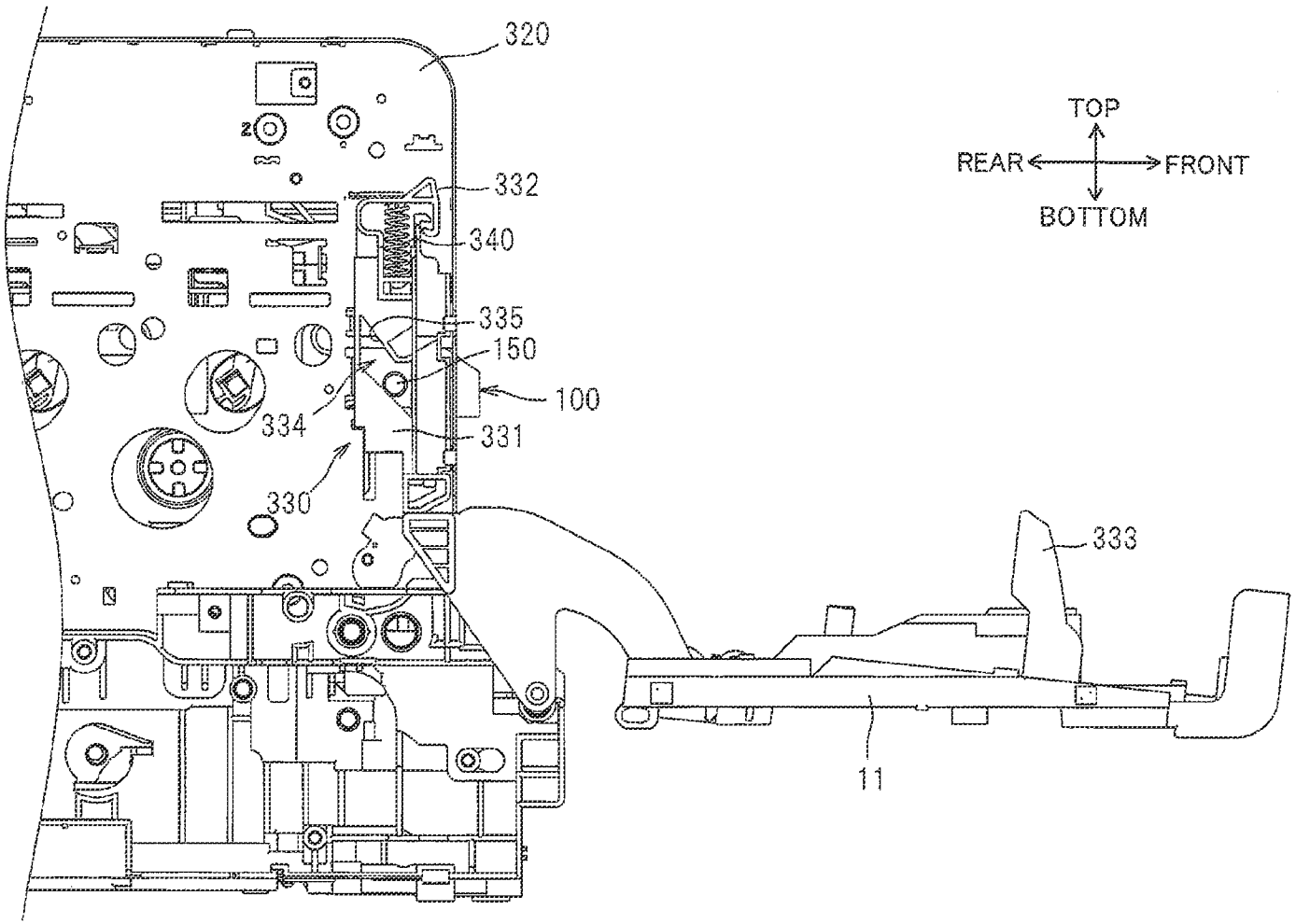
FIG. 9 is a view showing a construction around a pressing mechanism of the color printer when a front cover is opened.

The main body 10 is provided with a pair of left and right guides 310 (see FIGS. 7A through 8B), a pair of left and right metal side frames 320, and a pair of left and right pressing mechanisms 330 (see FIG. 9).

The guides 310 are examples of a claimed positioning section functioning to perform positioning of the paper dust roller 23A relative to the pinch roller 23B. The positioning of the paper dust roller 23A in the front-to-rear direction is determined by inserting the bearing parts 231 of the cleaning unit 200 into the corresponding guides 310.

More specifically, the guides 310 are provided in a form of a groove above left and right end portions of the pinch roller 23B and extend along the biasing direction of the coil springs 270. Each guide 310 has a rear guide 311 and a front guide 312 for guiding respective rear and front sides of the bearing parts 231.

Each rear guide 311 has an upper end positioned above an upper end of the corresponding front guide 312 so as to make contact with the corresponding bearing part 231 when the drawer 100 is moving from the external position to the internal position. Accordingly, when the drawer 100 is being mounted in the main body 10, the bearing parts 231 first contact the rear guides 311, then begin moving frontward relative to the drawer 100 while being guided between the rear guides 311 and front guides 312.

As shown in FIG. 9, the left and right side frames 320 are provided to be positioned laterally outward of left and right outer surfaces of the drawer 100 at the internal position respectively. Guide parts (not shown) are formed on inner surfaces of the side frames 320 for contacting and guiding the drawer 100 when the drawer 100 is being mounted in the main body 10.

The pressing mechanisms 330 are configured to apply pressure to the shaft 150 of the drawer 100 when the front cover 11 is closed, thereby applying pressure to the drawer 100 against the biasing force of the coil springs 270.

More specifically, each pressing mechanism 330 is configured of a linearly movable cam 331 supported on the corresponding side frame 320 and capable of moving vertically relative to the same, a contact-receiving member 332 integrally fixed to the linearly movable cam 331 and having an internal space for accommodating a coil spring 340, and a contact member 333 provided on the front cover 11. A groove 334 is formed in the linearly movable cam 331. The groove 334 has a sloped surface 335 with its rear end positioned above its front end. The shaft 150 of the drawer 100 is disposed in the groove 334 when the drawer 100 is in the internal position.

Figure 10B:
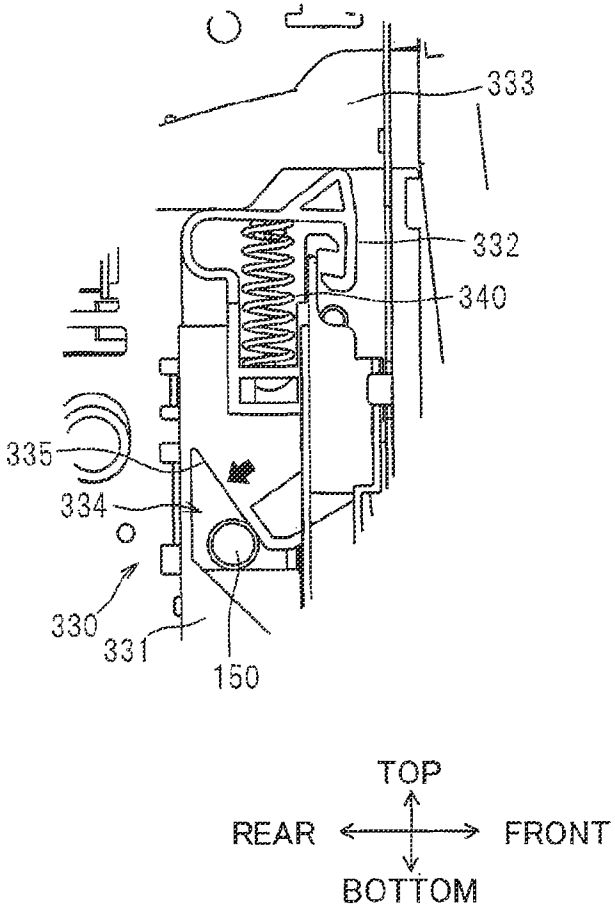
FIGS. 10A and 10B are views showing the construction around the pressing mechanism of the color printer when the front cover is closed.
Figure 10A:
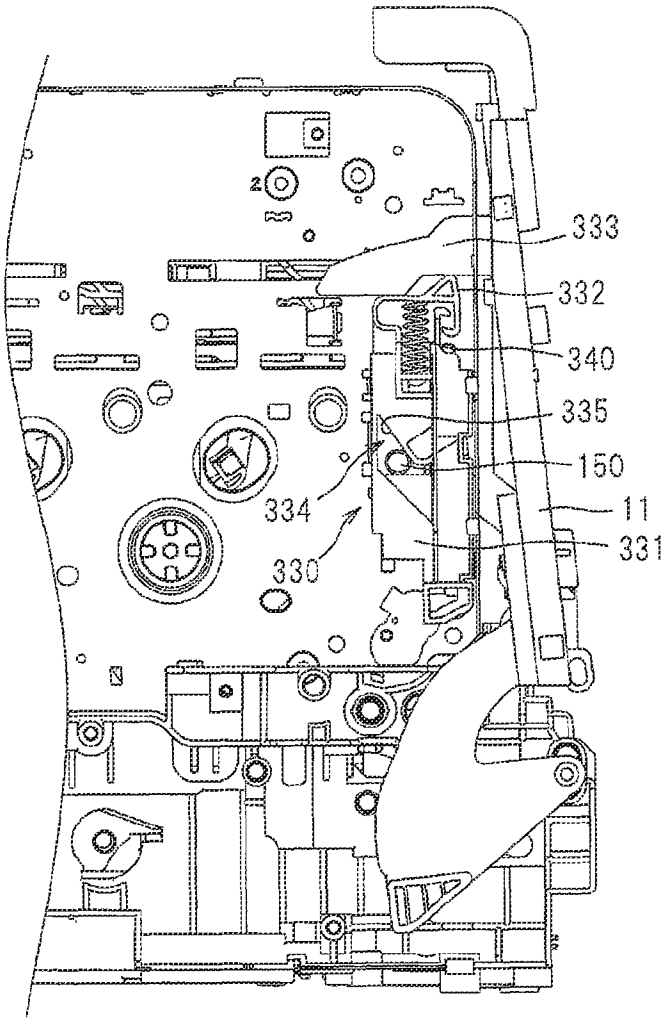

When the front cover 11 is closed, as illustrated in FIGS. 10A and 10B, the contact member 333 contacts a top portion of the contact-receiving member 332, causing the top portion to move downward. When the top portion of the contact-receiving member 332 is pushed downward, the coil spring 340 accommodated in the contact-receiving member 332 is compressed, and the linearly movable cam 331 moves downward. At this time, the shaft 150 of the drawer 100 disposed in the grooves 334 is pressed rearward and downward by the sloped surfaces 335 of the grooves 334. When the front cover 11 is closed, the drawer 100 is in the internal position (fixed in position relative to the main body 10) and positioning of the cleaning unit 200 relative to the pinch roller 23B is achieved by the bearing parts 231 being received by the guides 310.

The following operations and effects can be obtained through the embodiment described above.

As described above, the cleaning unit 200 is provided on the drawer 100 in such a way that the cleaning unit 200 can move relative to the drawer 100 in the front-to-rear direction. Accordingly, when the drawer 100 is moved from the external position to the internal position, the bearing parts 231 of the cleaning unit 200 contact the guides 310 in the main body 10, and the cleaning unit 200 pivotally moves upward and forward as the bearing parts 231 are fitted into the corresponding guides 310, as illustrated in FIGS. 7A and 8B. The paper dust roller 23A is pushed against the pinch roller 23B by the biasing force of the coil springs 270 and is subject to positioning relative to the pinch roller 23B. When moved to this internal position, the drawer 100 achieves its positioning relative to the main body 10 by the positioning portion (not shown).

In this way, positioning of the paper dust roller 23A relative to the pinch roller 23B is performed independently of the positioning of the drawer 100 relative to the main body 10. Therefore, positioning of the paper dust roller 23A can be achieved with greater accuracy.

Incidentally, at this time, the second protrusion 125 of the left cleaning-unit retaining part 122 is not engaged with the engaging hole 253 of the cleaning unit 200, as shown in FIG. 8B. However, the first protrusion 124 of the left cleaning-unit retaining part 122 is engaged with the elongate hole 235 of the cleaning unit 200. Further, while not shown in the drawings, one of the two protrusions 236 of the cleaning unit 200 is not engaged with the support hole (engaging hole) formed in the right cleaning-unit retaining part 123, but the remaining one of the protrusions 236 is engaged with the elongate hole formed in the right cleaning-unit retaining part 123.

With this configuration, the cleaning unit 200 is allowed to move relative to the drawer 100 along a longitudinal direction of the elongate hole 235 (a direction in which the elongate hole 235 extends), thereby preventing the positioning of the paper dust roller 23A relative to the pinch roller 23B from affecting the positioning of the drawer 100 relative to the main body 10, and vice versa. This configuration also restricts movement of the cleaning unit 200 relative to the drawer 100 in a direction orthogonal to the longitudinal direction of the elongate hole 235 (a direction parallel to the confronting direction of the registration rollers 23). Accordingly, the orientation of the cleaning unit 200 when the paper dust roller 23A is fixed in position can be determined to a degree.

When the front cover 11 is closed after the drawer 100 has been inserted into the main body 10, the pressing mechanisms 330 apply pressure to the shaft 150 of the drawer 100 against the biasing force of the coil springs 340, as shown in FIG. 10B. Accordingly, the drawer 100 is prevented from floating off the main body 10 due to receipt of the force of the coil springs 270 disposed between the drawer 100 and the cleaning unit 200.

The cleaning unit 200 also moves together with the drawer 100 when the drawer 100 is moved from the internal position to the external position. Therefore, the cleaning unit 200 does not interfere with movement of the drawer 100 as the drawer 100 is pulled out of the main body 10.

Providing the cleaning unit 200 on the drawer 100 makes it possible to replace the cleaning unit 200 at the same time the drawer 100 is replaced. Therefore, even the storing part 232 with a small capacity can store a sufficient amount of paper dust, unlike when the cleaning unit 200 is provided in the main body 10. Further, since the tube 211 provided on the paper dust roller 23A incurs little wear, the tube 211 with a smaller thickness can be used to reduce manufacturing costs.

Since the paper dust roller 23A separates from the pinch roller 23B when the drawer 100 is pulled out of the main body 10, a sheet P that becomes jammed in the registration rollers 23 (between the paper dust roller 23A and the pinch roller 23B) can easily be removed by pulling the drawer 100 out of the main body 10.

When the drawer 100 is moved from the internal position to the external position, the biasing force of the coil springs 270 pivotally moves the cleaning unit 200 downward and rearward. At this time, the second protrusion 125 of the left cleaning-unit retaining part 122 engages the engaging hole 253 of the cleaning unit 200, as shown in FIG. 7B, and one of the protrusions 236 of the cleaning unit 200 engages the support hole (not shown) formed in the right cleaning-unit retaining part 123. These engagements maintain the orientation of the cleaning unit 200 relative to the drawer 100 when the drawer 100 is in the external position.

Various variations and modifications are conceivable.

In the embodiment described above, the paper dust roller 23A is fixed in position relative to the pinch roller 23B by engaging the bearing parts 231 provided on the cleaning unit 200 with the guides 310 provided in the main body 10, but the present invention is not limited to this configuration. For example, positioning of the paper dust roller 23A relative to the pinch roller 23B may be performed when the drawer 100 is moved from the external position to the internal position by the peripheral surface of the paper dust roller 23A contacting the peripheral surface of the pinch roller 23B and the coil springs 270 biasing the paper dust roller 23A toward the pinch roller 23B.

In the embodiment described above, the second protrusion 125 is an example of an engaging portion provided on the drawer 100, and the engaging hole 253 is an example of an engaged portion provided in the cleaning unit 200, but the present invention is not limited to this configuration. That is, the engaging portion and the engaged portion may have any arbitrary form that can restrict the cleaning unit 200 from moving due to the biasing force of biasing members (the coil springs 270 in the embodiment). For example, both the engaging part and engagement part may be protrusions that are configured to engage each other when the drawer 100 is moved to the external position.

In the embodiment described above, the universal joint 214 functions to connect the input gear 212 to the rotational shaft 213 of the paper dust roller 23A, but the input gear 212 may be connected to the rotational shaft 213 with an Oldham coupling, for example.

In order to provide a fluoropolymer on the peripheral surface of the paper dust roller 23A in the depicted embodiment, the tube 211 formed of a fluoropolymer is fitted over the paper dust roller 23A, but the peripheral surface of the paper dust roller 23A may be coated with a fluoropolymer instead.

In the preferred embodiment, the present invention is applied to the color printer 1, but the present invention may be applied to another image forming apparatus, such as a photocopier or a multifunction device.

While the invention has been described in detail with reference to the embodiments thereof, it would be apparent to those skilled in the art that various changes and modifications may be made therein without departing from the spirit of the invention.

What is claimed is:

1. An image forming apparatus comprising:

a main body having a pinch roller;

a supporting member configured to support a plurality of cartridges and configured to move, relative to the main body, between an internal position located inside the main body and an external position located outside the main body; and a cleaning unit provided on the supporting member, the cleaning unit including:

a paper dust roller configured to nip a recording sheet in conjunction with the pinch roller for removing the paper dust from the recording sheet, the paper dust roller being movable relative to the supporting member, positioning of the paper dust roller relative to the pinch roller being independent of positioning of the supporting member relative to the main body;

a paper dust removing member configured to remove the paper dust from the paper dust roller; and a storing section configured to store the paper dust removed by the paper dust removing member.

2. The image forming apparatus according to claim 1, wherein the main body further includes a positioning section for performing positioning of the paper dust roller relative to the pinch roller; and wherein the cleaning unit further includes a positioned portion configured to be engaged with the positioning section when the supporting member is at the internal position, the paper dust roller being positioned relative to the pinch roller by engagement of the positioned portion with the positioning section.

3. The image forming apparatus according to claim 2, further comprising a biasing member configured to bias the positioned portion toward the positioning section.

4. The image forming apparatus according to claim 3, wherein the biasing member is disposed between the cleaning unit and the supporting member; and wherein the main body further includes a pressing mechanism configured to apply a pressing force to the supporting member against a biasing force of the biasing member.

5. The image forming apparatus according to claim 3, wherein the paper dust roller defines an axis extending in an axial direction;

wherein the supporting member includes a side supporting wall and a protrusion protruding in the axial direction from the side supporting wall; and wherein the cleaning unit is formed with an elongate hole and configured to be engaged with the protrusion, the cleaning unit being supported to the supporting member by engagement between the elongate hole and the protrusion to permit the cleaning unit to move in the elongate hole relative to the supporting member.

6. The image forming apparatus according to claim 5, wherein the supporting member further includes an engaging portion; and wherein the cleaning unit includes an engaged portion configured to be engaged with the engaging portion, the engaging portion and the engaged portion being configured not to engage each other when the cleaning unit is at the internal position, the engaging portion and the engaged portion being configured to engage each other when the cleaning unit at the external position for restricting the cleaning unit from moving relative to the supporting member upon receipt of a biasing force of the biasing member.

7. The image forming apparatus according to claim 3, wherein the paper dust roller defines an axis extending in an axial direction;

wherein the supporting member includes a side supporting wall in which an elongate hole is formed; and wherein the cleaning unit includes a protrusion protruding in the axial direction, the cleaning unit being supported to the supporting member by engagement between the elongate hole and the protrusion to permit the cleaning unit to move in the elongate hole relative to the supporting member.

8. The image forming apparatus according to claim 7, wherein the supporting member further includes an engaging portion; and wherein the cleaning unit includes an engaged portion configured to be engaged with the engaging portion, the engaging portion and the engaged portion being configured not to engage each other when the cleaning unit is at the internal position, the engaging portion and the engaged portion being configured to engage each other when the cleaning unit at the external position for restricting the cleaning unit from moving relative to the supporting member upon receipt of a biasing force of the biasing member.

9. The image forming apparatus according to claim 1, wherein the paper dust roller is provided with an inputting member to which a driving force is applied to transmit the driving force to the paper dust roller; and wherein the inputting member is connected to the paper dust roller such that the inputting member can be displaced in a radial direction of the paper dust roller.

10. The image forming apparatus according to claim 9, wherein the inputting member is connected to the paper dust roller by a universal joint.

11. The image forming apparatus according to claim 1, wherein the paper dust roller has a peripheral surface that is coated with a fluoropolymer.

12. The image forming apparatus according to claim 1, further comprising:

a plurality of photosensitive members;

a first grounding member for grounding the photosensitive members; and a second grounding member for grounding the paper dust roller, the second grounding member being electrically connected to the first grounding member to be grounded via the first grounding member.

* * * * *